US010207778B1

(12) United States Patent
Bohanan et al.

(10) Patent No.: US 10,207,778 B1
(45) **Date of Patent: *Feb. 19, 2019**

(54) WAKE TOWER APPARATUS AND METHOD OF MAKING SAME

(71) Applicant: Protomet Corporation, Oak Ridge, TN (US)

(72) Inventors: Jeff Bohanan, Powell, TN (US); William M. Reid, Knoxville, TN (US); Michael Shane Garner, Philadelphia, TN (US); Dale Lee Lambert, Oak Ridge, TN (US)

(73) Assignee: Protomet Corporation, Oak Ridge, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/850,903

(22) Filed: Dec. 21, 2017

Related U.S. Application Data

(63) Continuation of application No. 15/169,380, filed on May 31, 2016, now Pat. No. 9,849,946.

(60) Provisional application No. 62/168,398, filed on May 29, 2015.

(51) Int. Cl.
*B63B 35/81* (2006.01)

(52) U.S. Cl.
CPC ..... *B63B 35/815* (2013.01)

(58) Field of Classification Search
CPC ..... B63B 35/815
See application file for complete search history.

(56) References Cited

U.S. PATENT DOCUMENTS

| | | | | |
|---|---|---|---|---|
| 3,877,712 | A * | 4/1975 | Weckeiser | A63C 9/082 280/614 |
| 5,979,350 | A * | 11/1999 | Larson | B63B 15/00 114/253 |
| 6,374,762 | B1 * | 4/2002 | Larson | B63B 15/00 114/253 |
| 6,666,159 | B2 | 12/2003 | Larson et al. | |
| 6,792,888 | B1 | 9/2004 | Metcalf | |
| 6,986,321 | B2 * | 1/2006 | Metcalf | B63B 15/00 114/253 |

(Continued)

OTHER PUBLICATIONS

Office Action dated Jan. 13, 2017, in U.S. Appl. No. 15/169,380.

*Primary Examiner* — Lars A Olson
*Assistant Examiner* — Jovon E Hayes
(74) *Attorney, Agent, or Firm* — Matthew M. Googe; Robinson IP Law, PLLC

(57) ABSTRACT

A wake tower assembly for use with a watercraft, including an arch portion extending across a width of the watercraft, first and second pivoting structures coupled to first and second ends of the arch portion, the first and second pivoting structures configured to attach to port and starboard portions of the watercraft to facilitate rotational movement of the arch portion between a lowered position and an upright position, and a first locking mechanism provided to the first pivoting structure including a biased pin member configured to engage an opening of the first end such that when the arch portion is rotated from the lowered position to the upright position, a biasing force of the biased pin member causes the biased pin member to engage the opening to mechanically lock the arch portion in the upright position.

11 Claims, 20 Drawing Sheets

(56) References Cited

U.S. PATENT DOCUMENTS

| | | | | |
|---|---|---|---|---|
| 7,219,617 | B2 * | 5/2007 | Metcalf | B63B 15/00 114/253 |
| 7,234,408 | B1 * | 6/2007 | Clemmons | B63B 35/816 114/253 |
| 7,299,761 | B2 | 11/2007 | Larson et al. | |
| 7,392,758 | B2 * | 7/2008 | Metcalf | B63B 15/00 114/253 |
| 8,171,874 | B2 * | 5/2012 | Gasper | B63B 35/815 114/253 |
| 8,196,542 | B2 * | 6/2012 | Oswell | B63B 35/816 114/343 |
| 8,485,119 | B2 * | 7/2013 | Gasper | B63B 35/815 114/253 |
| 8,555,802 | B2 * | 10/2013 | Oswell | B63B 35/816 114/343 |
| 9,038,875 | B2 * | 5/2015 | Jesewitz | B63B 25/002 114/343 |
| 9,061,748 | B2 * | 6/2015 | Metcalf | B63B 35/816 |
| 2006/0180072 | A1 * | 8/2006 | Metcalf | B63B 15/00 114/364 |
| 2008/0264325 | A1 * | 10/2008 | Tevlin | B63B 15/00 114/364 |
| 2009/0178604 | A1 * | 7/2009 | McKeand | B63B 15/00 114/343 |
| 2009/0314194 | A1 * | 12/2009 | Metcalf | B63B 35/815 114/253 |
| 2015/0048130 | A1 * | 2/2015 | Jesewitz | B63B 25/002 224/406 |

* cited by examiner

WAKE TOWER APPARATUS AND METHOD OF MAKING SAME

CROSS-REFERENCE TO RELATED APPLICATION

This application claims priority to and is a continuation of U.S. patent application Ser. No. 15/169,398 for a "Wake Tower Apparatus and Methods of Making Same" filed on May 31, 2016, which claims priority to U.S. Provisional Patent Application Ser. No. 62/168,398 filed on May 29, 2015, the contents of which are hereby incorporated by reference in their entireties.

FIELD OF INVENTION

The present general inventive concept relates to a wake tower for use with a watercraft. More specifically, the present general inventive concept relates to a pivoting wake tower apparatus for use in water sports such as wakeboarding for towing a participant behind a powerboat and for storing accessories of the watercraft.

BACKGROUND

Conventional support structures for towing participants behind a power boat are generally designed to include a combination of bent tubing, machined bar stock, and cast components. The individual components are typically manufactured using standard manufacturing processes to include casting, tube bending, and machining. The individual components are generally bolted and welded in a structural form to meet the design objective of creating an arch like structure that is attached to the port and starboard gunwales of the boat and transverse the boat from port to starboard at a height above the operator so as not to interfere with the operation of the boat. These support structures may be referred to as towers, or wake towers.

Since their inception, methods of constructing conventional wake towers have included welding components together. The welding process introduces stress and dimensional distortion into the assembled components. Welding jigs and fixtures may be used to hold parts in place and minimize distortion. However, the final assembly will typically experience significant degrees of dimensional distortion after being released from the welding fixture.

Also, the heat from a welding process may negatively impact the material adjacent to the weld. If a weld tower fails under load, the root cause can often be found in the area adjacent to the weld. Though weld joints tend to be strong, the heat affected material adjacent to a weld tends to be weak. Thus, a tower constructed without welding in accordance with embodiments of the present general inventive concept can solve such problems associated with conventional wake tower construction.

Conventional wake towers typically provide a vertical structure that is pivotally attached to a stationary base. The pivot function provides a mechanism to lower the vertical structure so that the vessel may pass under low structures and/or to reduce the vessel's profile for convenience of transport and storage. In addition to providing a platform for elevated towing to improve the aerial characteristics of wakeboard or other watersport performances, the wake tower can provide a mechanism for mounting and storing water sport accessories, entertainment accessories, or other devices, including bimini tops. However, the addition of accessories and bimini tops to the tower may add considerable weight to the wake tower. The combined weight of the tower and the installed accessories may create a situation where the tower is either too difficult or impossible for a user to manually raise and lower the tower. While this issue has been addressed by means of installing mechanical or gas springs to counterbalance the excessive loads, a problem persists in that it is difficult for an operator to lock the tower in the upright or vertical position as the operator is holding and letting go of the tower.

BRIEF SUMMARY

Example embodiments of the present general inventive concept can be achieved by providing a wake tower for use with a watercraft, including a pivoting structure with a locking mechanism to selectively lock the wake tower in either a lowered or upright position relative to the watercraft.

Example embodiments of the present general inventive concept may be achieved by providing a wake tower assembly for use with a watercraft, including an arch portion configured to extend across a width of the watercraft, first and second pivoting structures respectively coupled to first and second ends of the arch portion wherein the first and second pivoting structures are configured to attach to port and starboard portions of the watercraft to facilitate rotational movement of the arch portion between a lowered and upright position relative to the watercraft, and a first locking mechanism provided to the first pivoting structure, the first locking mechanism including a biased pin member configured to engage an opening of the first end such that when the arch portion is rotated from the lowered position to the upright position, a biasing force of the biased pin member causes the biased pin member to engage the opening such that the biased pin member and opening cooperate to mechanically lock the arch portion in the upright position.

The wake tower assembly can include a second locking mechanism provided to the second pivoting structure, the second locking mechanism including a second pin member configured to engage an opening of the second end when the arch portion is in the lowered position to mechanically lock the arch portion in the lowered position, the second pin member being configured to engage another opening of the second end when the arch portion is in the upright position to mechanically lock the arch portion in the upright position.

Example embodiments of the present general inventive concept can also be achieved by providing a watercraft with a wake tower constructed in accordance with embodiments of the present general inventive concept.

Example embodiments of the present general inventive concept can also be achieved by providing a method of manufacturing a wake tower, including machining a plurality of components, each component being machined from a single billet of raw material, fastening each component to one or more of the other components in an overlapping manner to form the arch portion, without welding any of the components, and assembling first and second ends of the arch portion to first and second pivoting structures, respectively, to facilitate rotational movement of the arch portion relative to the pivoting structures.

Additional features and embodiments of the present general inventive concept will be apparent from the following detailed description, drawings, and claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
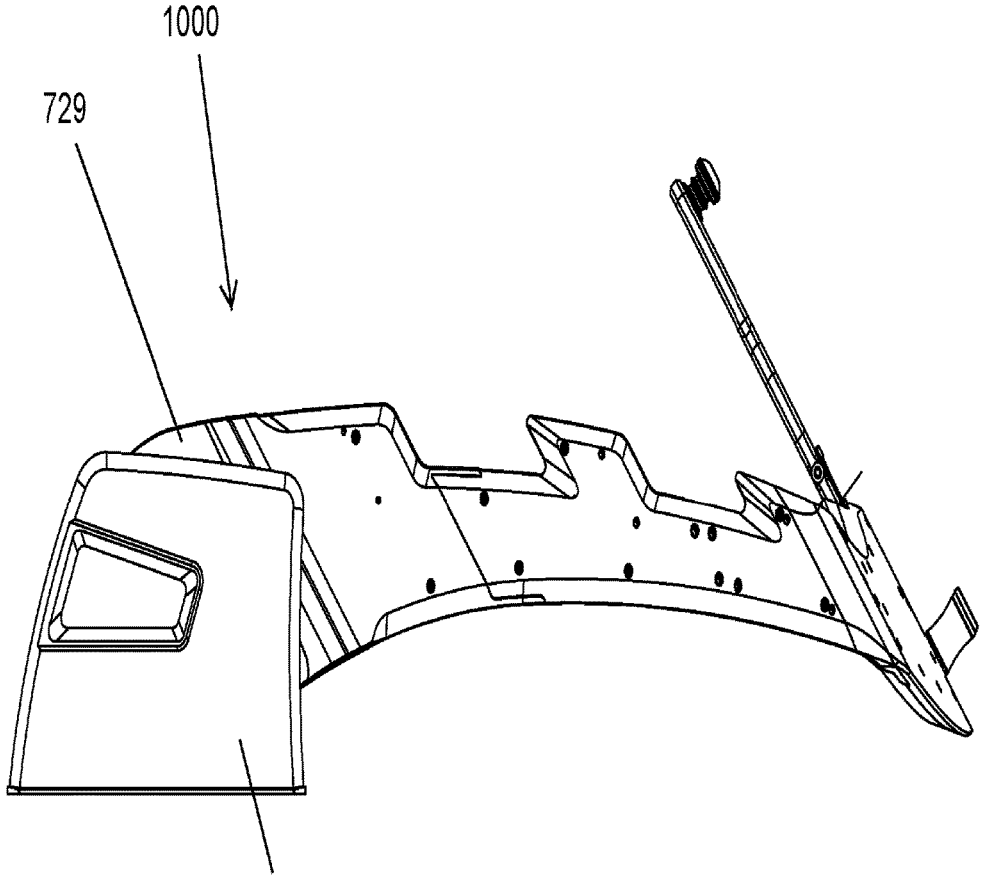
FIG. 1 illustrates a ski/wake tower in the lowered position according to an example embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various examples of the present general inventive concept, a method of constructing a wake tower is provided that includes forming components of the wake tower out of single billet aluminum and joining the components with lap joints without welding. Various example embodiments provide an automatic mechanical lock at a pivoting structure to allow a single user to be able to conveniently raise and lock the wake tower into an upright position.

An improved wake tower according to an example embodiment of the present general inventive concept may be precision machined from billet aluminum. The port and starboard base components may be assembled and installed onto an assembly fixture. The remaining structural components may be assembled into an arch-like structure and joined without welding using various securing members such as, for example, a combination of threaded fasteners and locating dowel pins. The precision and rigid arch-like structure may be pivotably attached to the port and starboard base components.

Gas springs are attached first to the base components and second to the upper arch assembly to provide a counterbalance force for manually raising and lowering the tower. An auto-locking mechanism is installed into one side of the tower such that a preloaded pin will fire and lock the tower when the tower is rotated to the raised position.

Accordingly, several advantages can be attributed to the precision assembly. The precision assembly may now be installed atop the port and starboard gunwales of a boat without the use of a come-along or an inordinate force that is typically required to overcome the dimensional distortion inherent in most welded towers. The dimensional consistency of a weld free tower provides a predictably repeatable process and results in a more efficient assembly process.

The precision assembly raises and lowers about a single axis pivot. The precision pivot provides a predictable force to raise and lower the tower. Gas springs can be specified to provide consistent forces required for one person to manually raise and lower the tower. An auto-locking mechanism allows the one person to preload the locking pin such that the tower can be raised by one person and the preloaded locking pin will fire allowing the tower to stay in the upright position when the one person lets go of the tower.

The wake tower constructed according to various example embodiments of the present general inventive concept provides numerous benefits over the conventional wake tower. For example, because no welding is involved in the construction of the wake tower, the potential for weld-induced stress cracks is eliminated. The absence of welding also eliminates the potential for weld-induced dimensional distortion. The absence of welding improves the precision construction of the wake tower, and thus simplifies and speeds the process of installation of the wake tower onto the boat. This eliminates the time consuming process and need for using a come-along to force the tower into a compliant position for assembly to the boat. The auto-locking mechanism enables one-person raising and lowering of the wake tower. The port and starboard sequential locking system enables one-person raising and lowering of the wake tower, as well as locking the wake tower in the down position. These are just a few of the benefits of various example embodiments of the wake tower configured according to the present general inventive concept.

According to various example embodiments of the present general inventive concept, the wake tower may be provided with a locking mechanism to allow a single user to raise the wake tower to the upright position and lock it into place. Typically, when moving a wake tower from a lowered position to an upright position, locks provided near pivot points on one or both sides of the wake tower must be disengaged, and then a first user will raise the wake tower by applying a force to a center portion of the wake tower. Then, while the first user holds the wake tower in the upright position, a second user will engage the locks provided near the pivot points to secure the wake tower in the upright position. Example embodiments of the present general inventive concept provide an "automatic" locking mechanism that can be configured at one of the pivot points to lock the wake tower in the upright position as soon as the wake tower is raised, such that a second person is not needed. After the wake tower is locked in the upright position by the locking mechanism provided on one side of the wake tower, the user may then engage the manual locks on the same and/or other side of the wake tower. It is noted that while the term wake tower is frequently used in these descriptions, such a tower may also be known as a ski/wake tower, wakeboard tower, and so on, and all are encompassed in that term.

Figure 2:
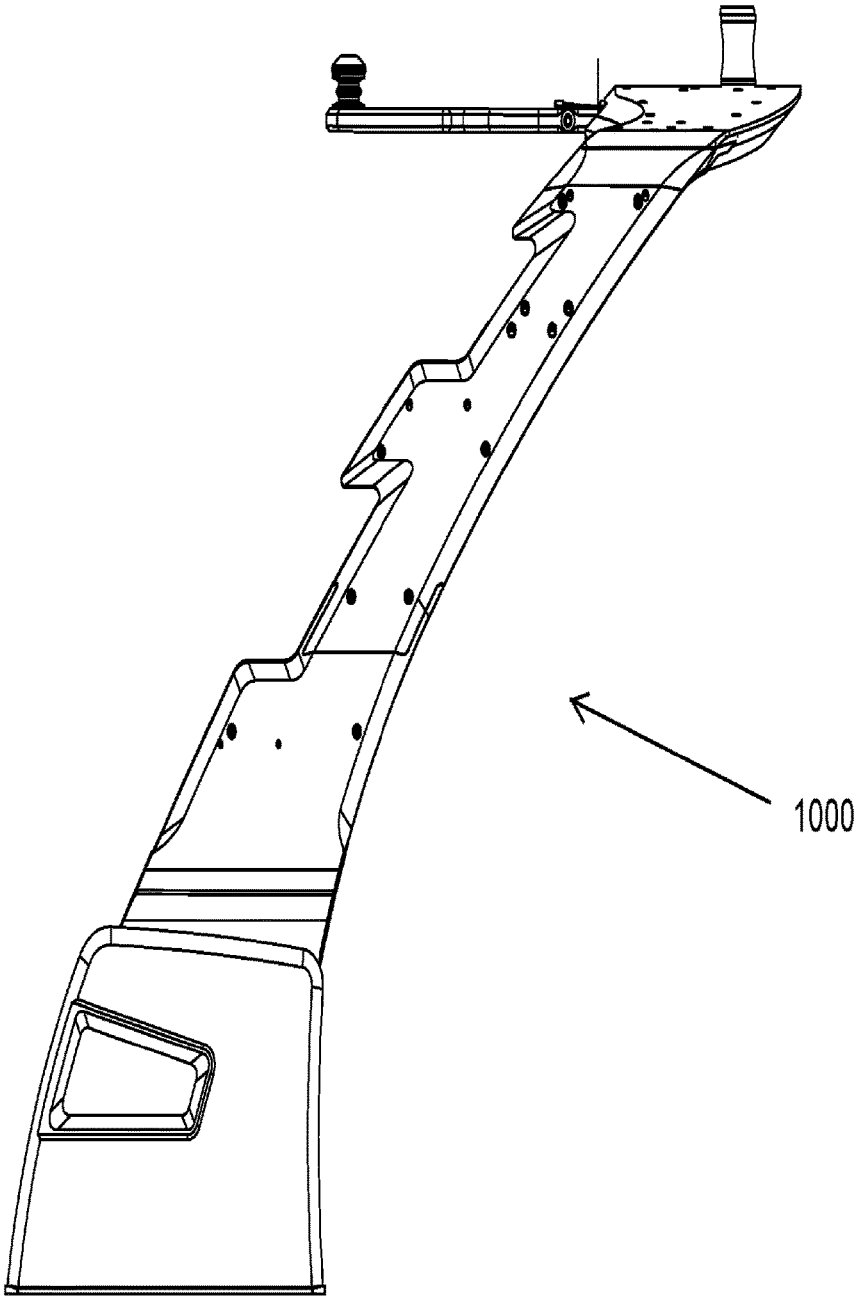
FIG. 2 illustrates the ski/wake tower of FIG. 1 in the raised position.

FIG. 1 illustrates a wake tower 1000 in the lowered position according to an example embodiment of the present general inventive concept. The lowered position is used when a boat is passing under a bridge, or being stored, and so on. The wake tower may be locked in the lowered position to prevent movement of the wake tower that may damage the tower or boat or persons on or near the boat. FIG. 2 illustrates the wake tower of FIG. 1 in the raised position for use with various water sports, the attachment of a bimini top, and so on. The wake tower can be locked in the upright position proximate at least one of the pivot points (769 in FIG. 3) about which the wake tower pivots.

Figure 3:
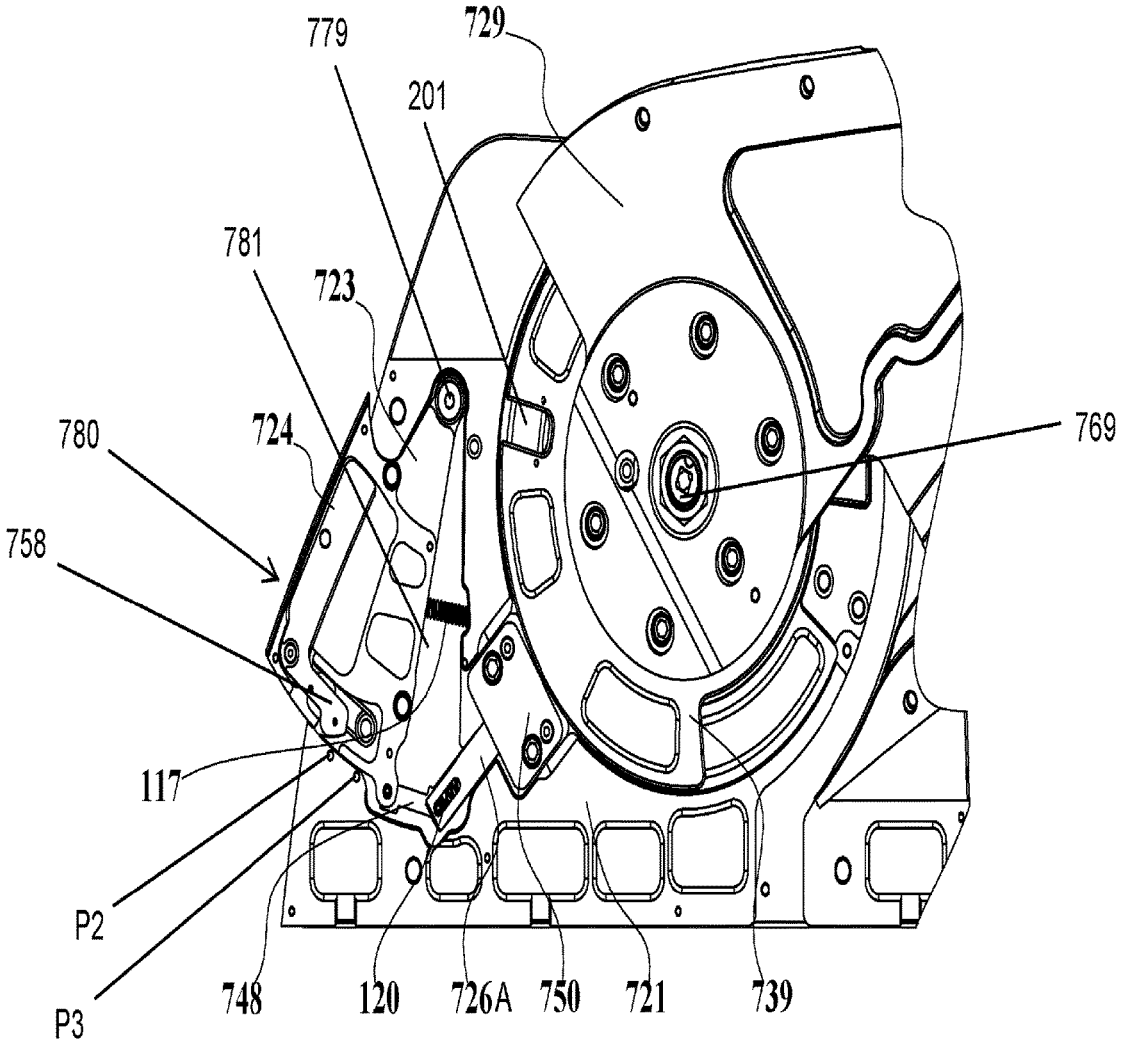
FIG. 3 illustrates a locking mechanism in the unlocked position according to an example embodiment of the present general inventive concept.

FIG. 3 illustrates a locking mechanism in the unlocked position according to an example embodiment of the present general inventive concept. The example locking mechanism illustrated in FIGS. 3-7 is described as being provided on the port side of the boat, but it is understood that this locking mechanism can be provided to either side, or both sides, of the boat, i.e., port and/or starboard sides, without departing from the scope of the present general inventive concept. In the embodiment illustrated in FIG. 3, a port leg base 729 of the wake tower is secured to a port ring 739, which is coupled to port base 721 to rotate around the port pivot point 769 of the wake tower. A handle lock assembly 780 is provided to the port base 721 to lock the port ring 739, and therefore the port leg base 729 and wake tower, into place when the wake tower is raised to the upright position. The handle lock assembly includes a handle 723, lever 724, link 748, lock pin 726A, and spring 120. The handle lock assembly may be referred to herein as the port handle lock assembly, and the various components thereof may be referred to as the port handle 723, port lever 724, and so on, although it is understood these components are not limited to the port side, and could be provided on the starboard side instead, or in addition to the port side. As illustrated in FIG. 3, the port leg base 729 is illustrated in the lowered position similar to FIG. 1, i.e., the wake tower is in the lowered or transport or storage position. In this embodiment, the port handle lock assembly 780 and port ring 739 are not configured to lock the wake tower in the lowered position, since the handle lock assembly and locking pin 726A are not engaged with the port ring 739. However, as described in further detail below with reference to FIGS. 9 and 17A-20B, locking in the transport position can be accomplished by the starboard lock assembly. The handle 723 is coupled to the base 721 at a point 779 around which the handle 723 rotates. In the example embodiment illustrated in FIG. 3, the handle 723 is configured to move reciprocally in a space provided in the port base 721. The lever 724 operates a lever plate 758 (illustrated more thoroughly in FIG. 8) which may be engaged in a pre-loaded and fully locked position of the handle lock assembly, but the lever plate 758 is not engaged with the base 721 in the unlocked position of the example embodiment illustrated in FIG. 3. The lock pin 726A is rotatably coupled to the handle 723, and the lock pin 726A is slidably and rotatably coupled to the link 748. In other words, the lock pin 726A is configured to both rotate around a coupling point of the link 748 and also slidably reciprocates along that coupling point. This allows the link 748 to transfer the movement of the handle 723 to the lock pin 726A to move the lock pin 726A in a reciprocating fashion towards and away from the ring 739, which will be described in more detail below. The lock pin 726A may also be biased in a direction away from the coupling point with the link 748, such that a full extension away from the link 748 is the resting state of the lock pin 726A. In the example embodiment illustrated in FIG. 3, the lock pin 726A is biased by a spring located internally to the lock pin 726A and abutting the coupling point of the link 748. In the fully unlocked position of the handle lock assembly illustrated in FIG. 3, the handle 723 is fully extended outward from the base 721 by a biasing member, for example a second compression spring 117 provided between handle 723 and the base 721, and therefore the lock pin 726A is fully extended from the link 748 with a distal end of the lock pin 726A located in a block 750 provided to the base 721. In this example embodiment, further outward rotation of the handle 723 (i.e., away from ring 739) may be arrested due to interference between handle 723 and base 721, but various other designs and methods of securing the handle 723 in the fully retracted position may be chosen using sound engineering judgement, and all such designs and methods are considered to be within the scope of the present general inventive concept.

Figure 4:
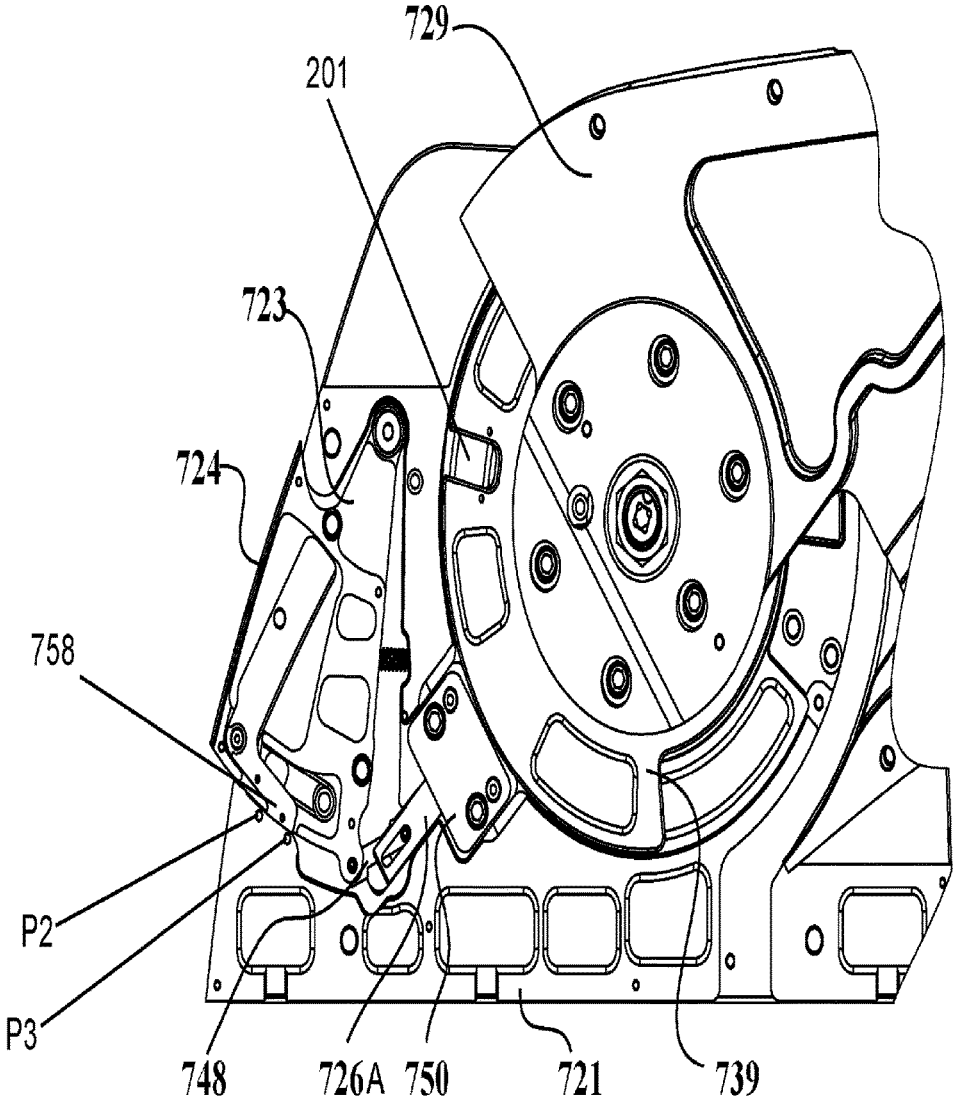
FIG. 4 illustrates the locking mechanism of FIG. 3 in a pre-loaded position.

FIG. 4 illustrates the locking mechanism of FIG. 3 in a pre-loaded position. Here, a distal end of the lever plate 758 is engaged against stop pin P2 such that the lock pin 726A becomes spring loaded against the outer diameter of ring 739. In this way, prior to raising the wake tower, a user may pre-load the locking mechanism by rotating the handle 723 such that the lever plate 758 moves from the fully retracted, or disengaged position of FIG. 3 toward stop pin P2 to latch on stop pin P2 between stop pin P3 and P2, as illustrated in FIG. 4. This movement from the disengaged position to the pre-loaded position serves to translate a load through the link 748 to move the lock pin 726A toward the outer diameter of ring 739 and to abut the ring 739, which in turn creates a spring pressure due to compression of compression spring 120 behind lock pin 726A, serving to pre-load the tip of the lock pin 726A against the outer diameter of ring 739. In this pre-loaded position, as the lock pin 726A abuts the ring 739, the first compression spring 120 is compressed to bias the lock pin 726A in the direction of the ring 739. Thus, the lock pin 726A of this example embodiment is spring-loaded against the ring 739. However, since the opening 201 is not aligned with the locking pin 726A, the lock pin 726A cannot penetrate the outer diameter of the port ring 739 because there is no slot for entry. In this pre-load position, the handle 723 is held in place by the lever plate 758 engaging with a portion of the base 721, which in this example embodiment is provided by stop pin P2. While embodiments of the present general inventive concept describe various positions of the handle 723 in terms of engagement of lever plate 758 against various stop pins P2, P3, etc., the present general inventive concept is not limited to any particular design or method of achieving and securing the various positions of the handle, and various other designs and/or methods of providing the disengaged, engaged, and pre-loaded positions may be chosen using sound engineering judgment, without departing from the scope of the present general inventive concept.

Figure 5:
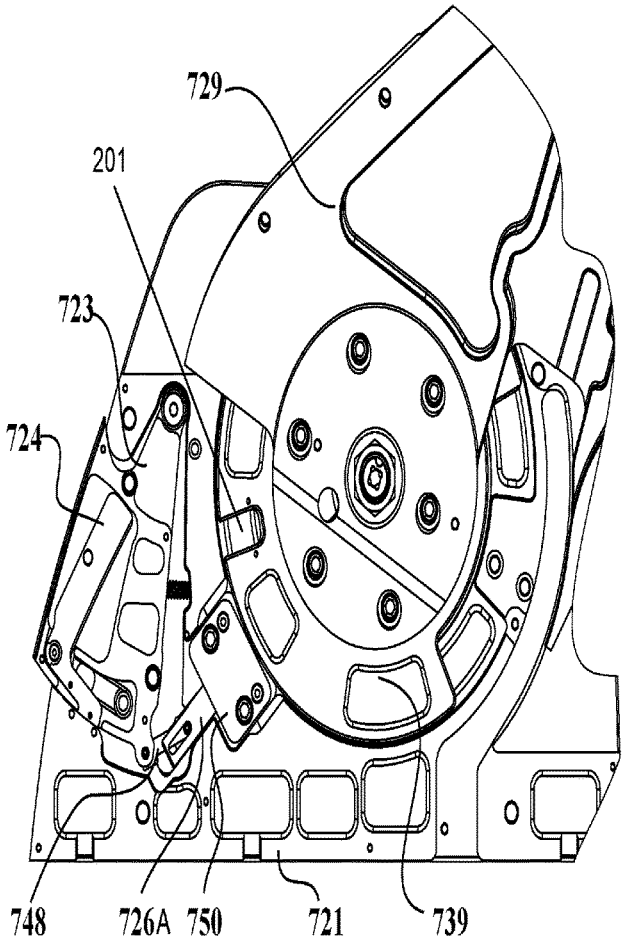
FIG. 5 illustrates the pre-loaded position of the locking mechanism of FIG. 4 being maintained as the wake tower is raised partway to the raised position.

After performing the pre-loading of the locking mechanism illustrated in FIG. 4, a user may begin to raise the wake tower toward the upright position. FIG. 5 illustrates the pre-loaded position of the locking mechanism of FIG. 4 being maintained as the wake tower is raised partway to the raised position. As illustrated in FIG. 5, the leg base 729 is partially rotated toward the raised position, and the locking assembly is held static with the lock pin 726A contacting the outer diameter of ring 739 due to there being no opening in the ring 739 to receive the biased lock pin 726A. As also illustrated in FIG. 5, an opening 201 in the ring 739 that is configured to receive the lock pin 726A is moving in the direction of the lock pin 726A as the leg base 729, and therefore the ring 739, is rotating to the upright position. The opening 201 in the ring 739 may be referred to herein as a ring slot. The lock pin 726A continues to ride along the outer diameter of the ring 739 until the ring slot 201 is in line with the lock pin 726A, which then allows the lock pin 726A to fire partially inside ring slot 201 (by virtue of lock pin 726A having been spring loaded against the outer diameter of ring 739). The firing of lock pin 726A into slot 201 serves to arrest further rotation of ring 739, as illustrated in FIG. 6.

Figure 6:
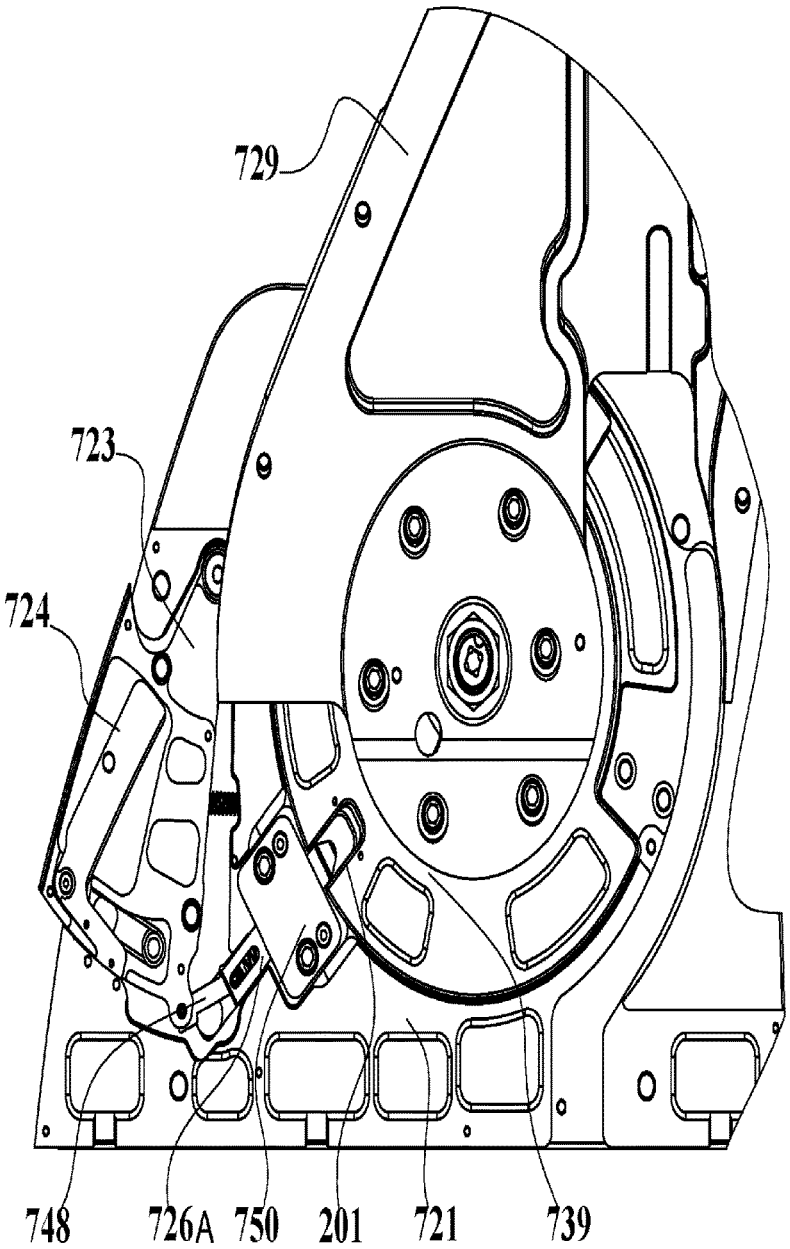
FIG. 6 illustrates the pre-loaded locking mechanism of FIG. 4 in the as-fired position that results from the wake tower being moved to the raised position.

FIG. 6 illustrates the pre-loaded locking mechanism of FIG. 4 in the as-fired position that results from the wake tower being moved to the raised position. When the upright position of the wake tower is achieved, and the lock pin 726A aligns with the ring slot, the preloaded lock pin 726A unloads the first compression spring 120 and fires into the ring slot 201. The fired position, as illustrated in FIG. 6, prevents the ring 739 from rotating. As the leg base 729 is secured to the ring 739 because of the presence of the lock pin 726A in the port ring slot 201, the leg base 729 is now locked in the raised position.

Figure 7:
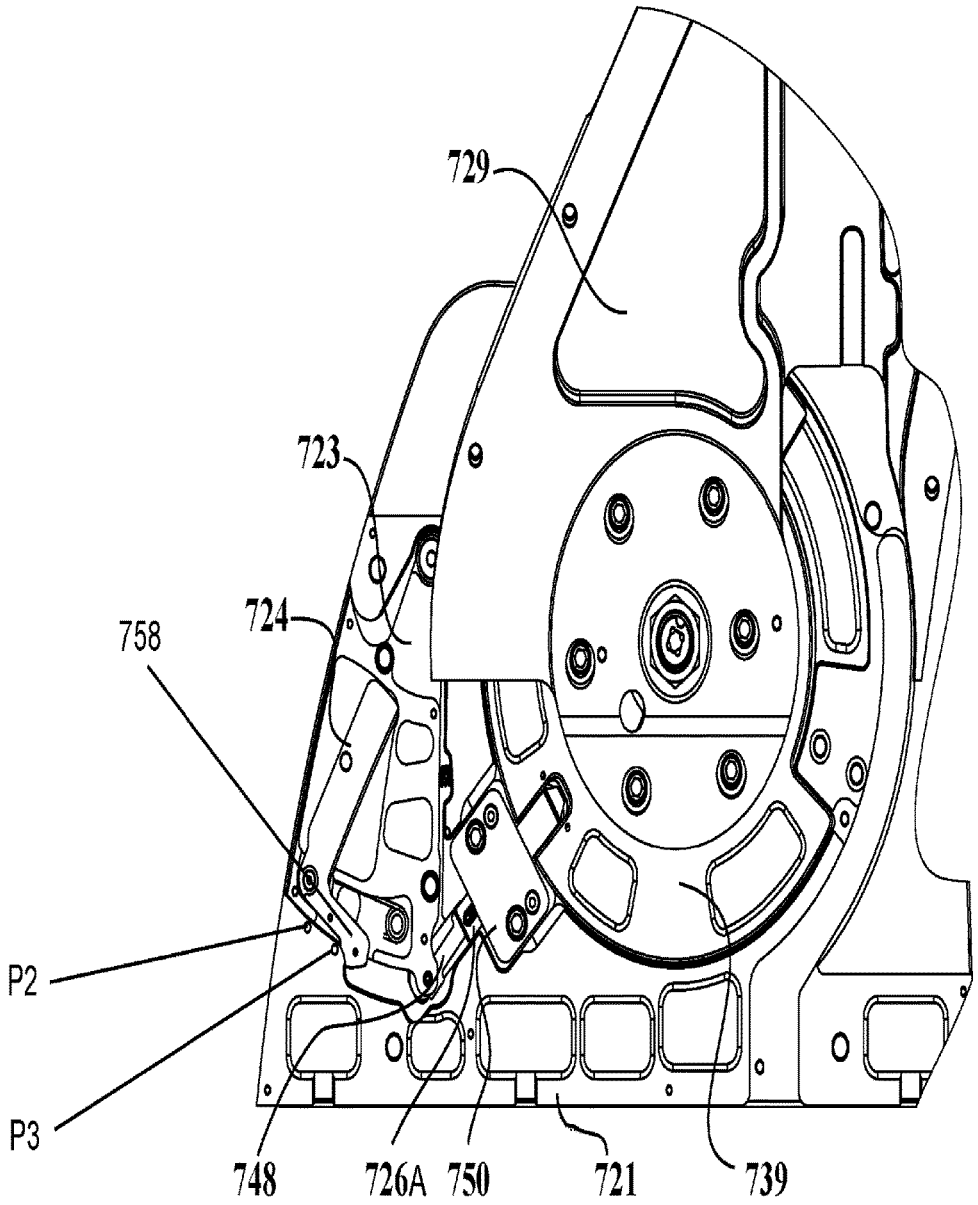
FIG. 7 illustrates the locking mechanism of FIGS. 3-6 in a locked position.

As a next step, the handle 723 may then be additionally rotated to further push the lock pin 726A into the port ring slot 201 for a secured locked position. In this embodiment, the handle 723 can be rotated such that the distal end of lever 758 engages stop pin P3 to secure the lock pin 726A such that lock pin 726A fully penetrates slot 201. FIG. 7 illustrates the locking mechanism of FIGS. 3-6 in the secured locked position. As illustrated in FIG. 6, the ring 739 is already locked by the presence of the lock pin 726A in the port ring slot 201, but lock pin 726A has only partially penetrated the port ring slot 201. When the user rotates the handle 723 farther into the secured locked position illustrated in FIG. 7, the load is translated by the link 748 to push the lock pin 726A further into the port ring slot 201. In the example embodiment illustrated in FIG. 7, the lock pin 726A is fully inserted so as to fully penetrate the ring slot 201. The lock pin 726A can be designed such that the tip of the pin 726A contacts a back portion of the ring slot 201. Here, the position of the handle 723 is secured in the locked position due to the interaction of the lever plate 758 and a recessed portion of the base 721 provided adjacent to stop pins P2 and P3 such that a distal end of the lever plate 758 engages, or latches the front of stop pin P3, to secure the handle 723 in the fully locked position.

Thus, a user can set the locking assembly such that the port handle is in the pre-loaded position before the user begins to raise the wake tower. Then, when the user has raised the wake tower to the upright position, the port ring slot 201 of the ring 739 receives the lock pin 726A to lock the wake tower in the upright position. The user may then let go of the wake tower and go to the handle 723 to push the handle 723 fully in to securely lock the locking assembly, and therefore the wake tower, is in place. The user may then go to the other ring, in this example the starboard ring, and manually place a lock on that side of the boat to further reinforce the upright position of the wake tower.

To disengage the locking assembly, the user simply has to use the port lever 724 of the handle lock assembly to disengage the lever plate 758 from the base 721, and then rotate the port handle outward away from the base 721 and ring 739. A biasing member such as a second compression spring 117 illustrated in FIG. 3 biases the port handle to maintain the outwardly rotated position of the port handle.

Figure 8:
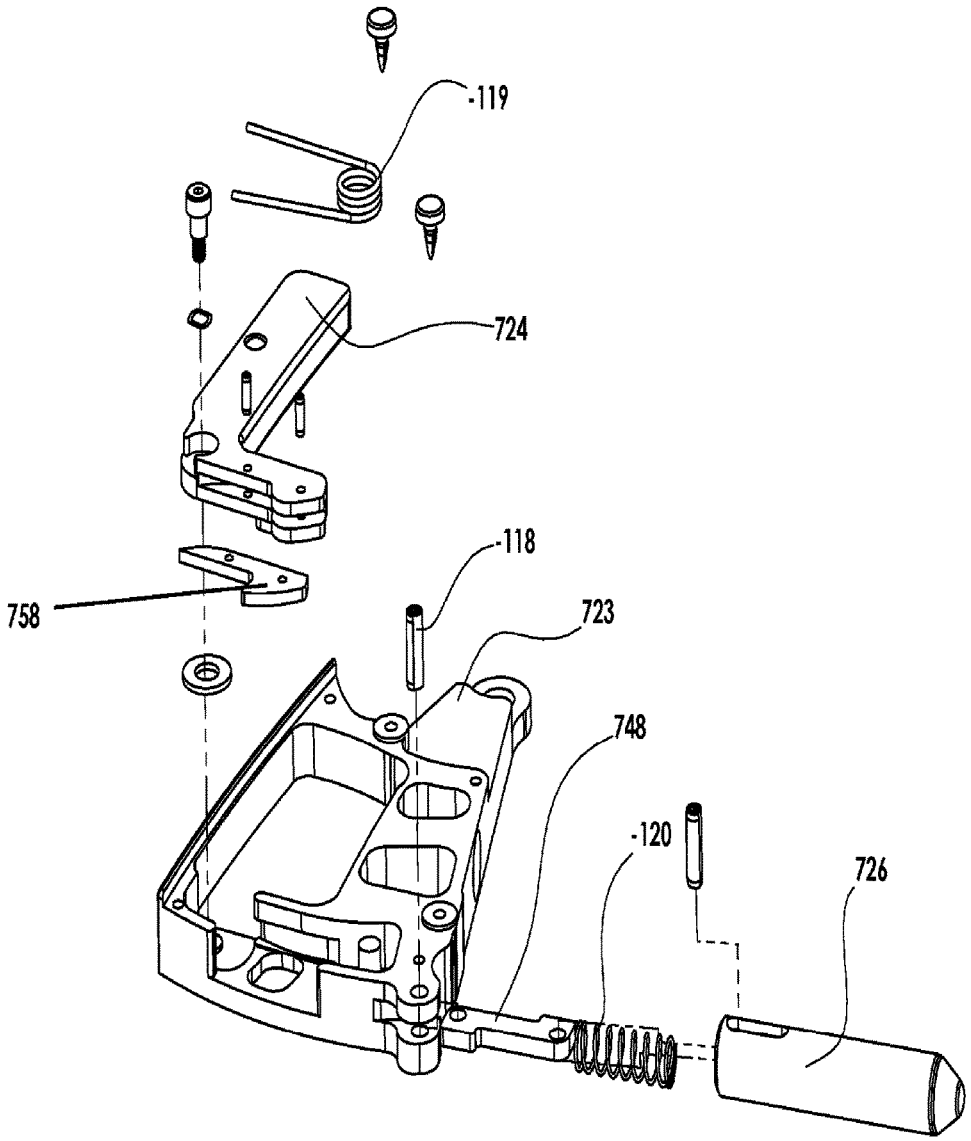
FIG. 8 illustrates an exploded view of a port handle lock assembly of the locking mechanism of FIG. 3 according to an example embodiment of the present general inventive concept.

FIG. 8 illustrates an exploded view of an example handle lock assembly of the locking mechanism of FIG. 3 according to an example embodiment of the present general inventive concept. As illustrated in FIG. 8, the handle assembly 723 is illustrated to include a lever member 724 which is configured to rotate around a point inside the handle 723, and is biased by a torsion spring 119 so that an associated lever plate 758 which can be coupled to the lever member 724 is fully extended in an unimpeded state. The lever member 724 and lever plate 758 can be formed as separate components or as a single component to work with handle 723. For convenience of description and illustration herein, the lever member 724 and plate 758 may be collectively referred to as lever 758 and handle 723, and may be referred to specifically as lever 758A, 758B and handle 723A, 723B, to distinguish between the port and starboard sides of the overall locking system of a wake tower. The handle 723 has a coupling portion so as to be rotatably coupled to the base 721. The link 748 is rotatably coupled to the handle 723 by a pin 118. The lock pin 726A is provided with a recessed portion to receive the first compression spring 120, and the recessed portion has at least one elongated opening along the side of the lock pin 726A to allow movement of a coupling pin in a reciprocal motion such that the lock pin 726A is able to both rotate about coupling point with the link 748, and also slidably reciprocate along that same coupling point.

Figure 9:
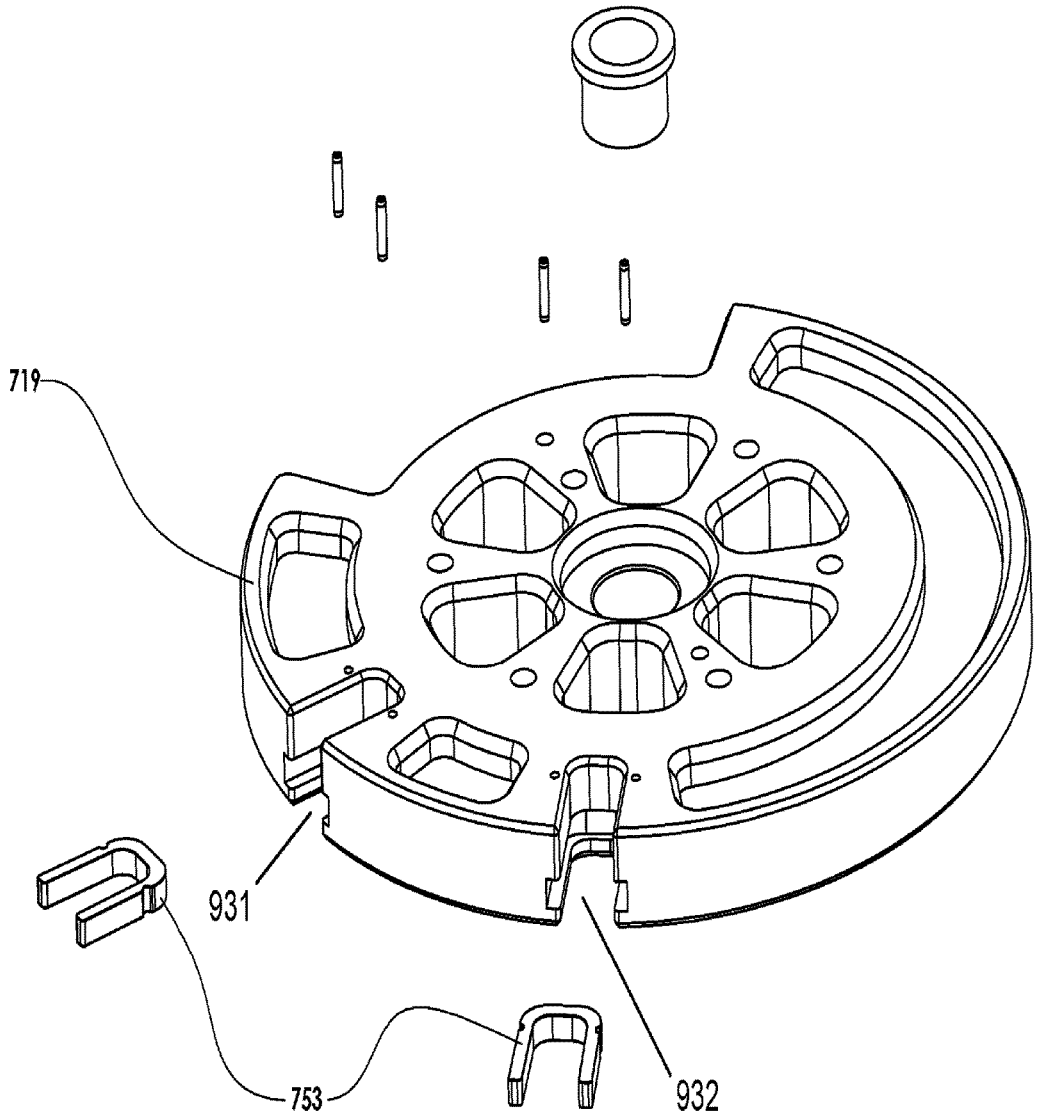
FIG. 9 is an exploded view of a starboard ring assembly according to an embodiment of the present general inventive concept.

FIG. 9 is an exploded view of a starboard ring assembly according to an embodiment of the present general inventive concept. The starboard ring 719 illustrated in FIG. 9 has two ring slots 931, 932 to receive a starboard locking pin 726B (see, e.g., FIGS. 17B, 18B, 19B, and 20B) in both the lowered and upright positions of the wake tower. Additionally, the starboard ring 719 of the example embodiment illustrated in FIG. 9 includes inserts 753 to reinforce the ring slots. In various example embodiments, the inserts 753 may be formed of a metal alloy, which may be harder than the material composing the starboard ring 719. Although these components are described as being on the starboard side, it is understood that the port and starboard components can be switched or interchanged from one side to the other, without departing from the scope of the present general inventive concept. It is also understood that the port side elements could be replicated on the starboard side, to provide similar locking mechanisms with engaged, pre-loaded, and disengaged positions on both sides of the boat. Such configuration is considered within the scope of the present general inventive concept.

Figure 10:
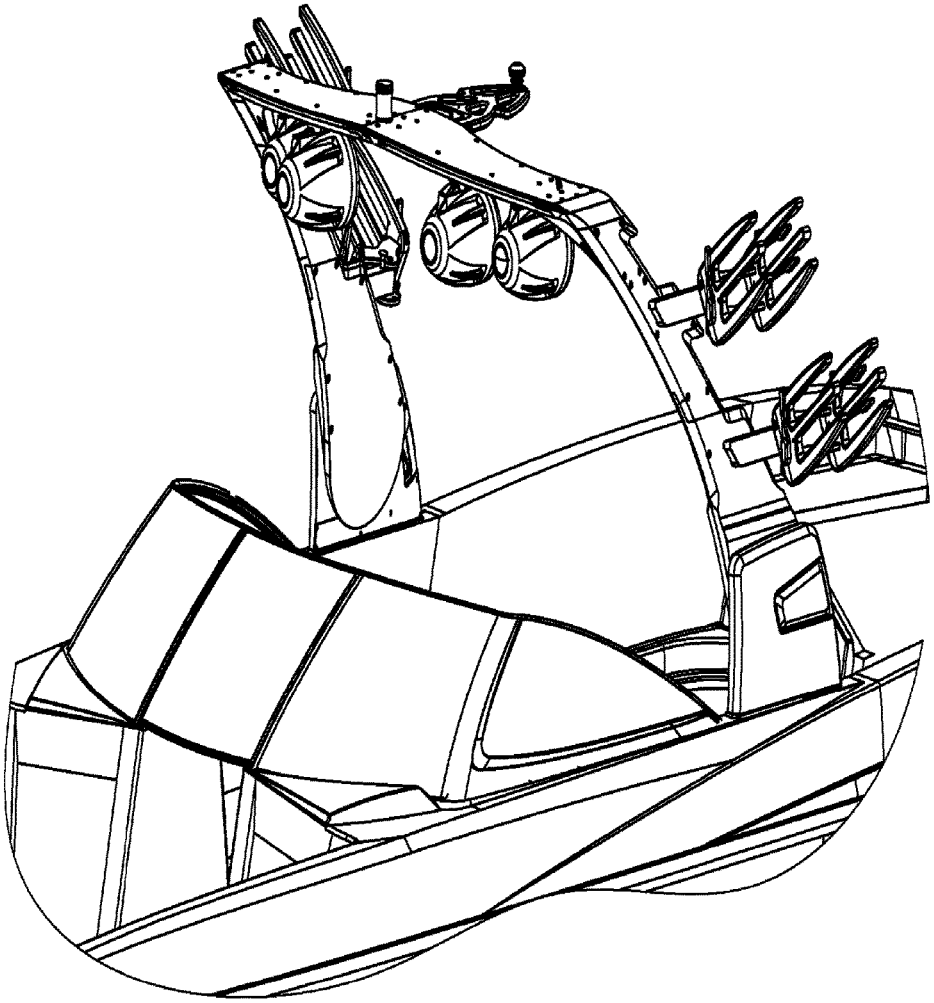
FIG. 10 illustrates an example ski/wake tower with various accessories attached and in the raised position according to an example embodiment of the present general inventive concept.

FIG. 10 illustrates a wake tower with various accessories attached and in the raised position according to an example embodiment of the present general inventive concept. As can be seen in FIG. 10, there are numerous possibilities of arrangement and load with the wake tower, and therefore a user would appreciate the convenience of both a sturdy wake tower, and easy methods of attaching the accessories.

Figure 11:
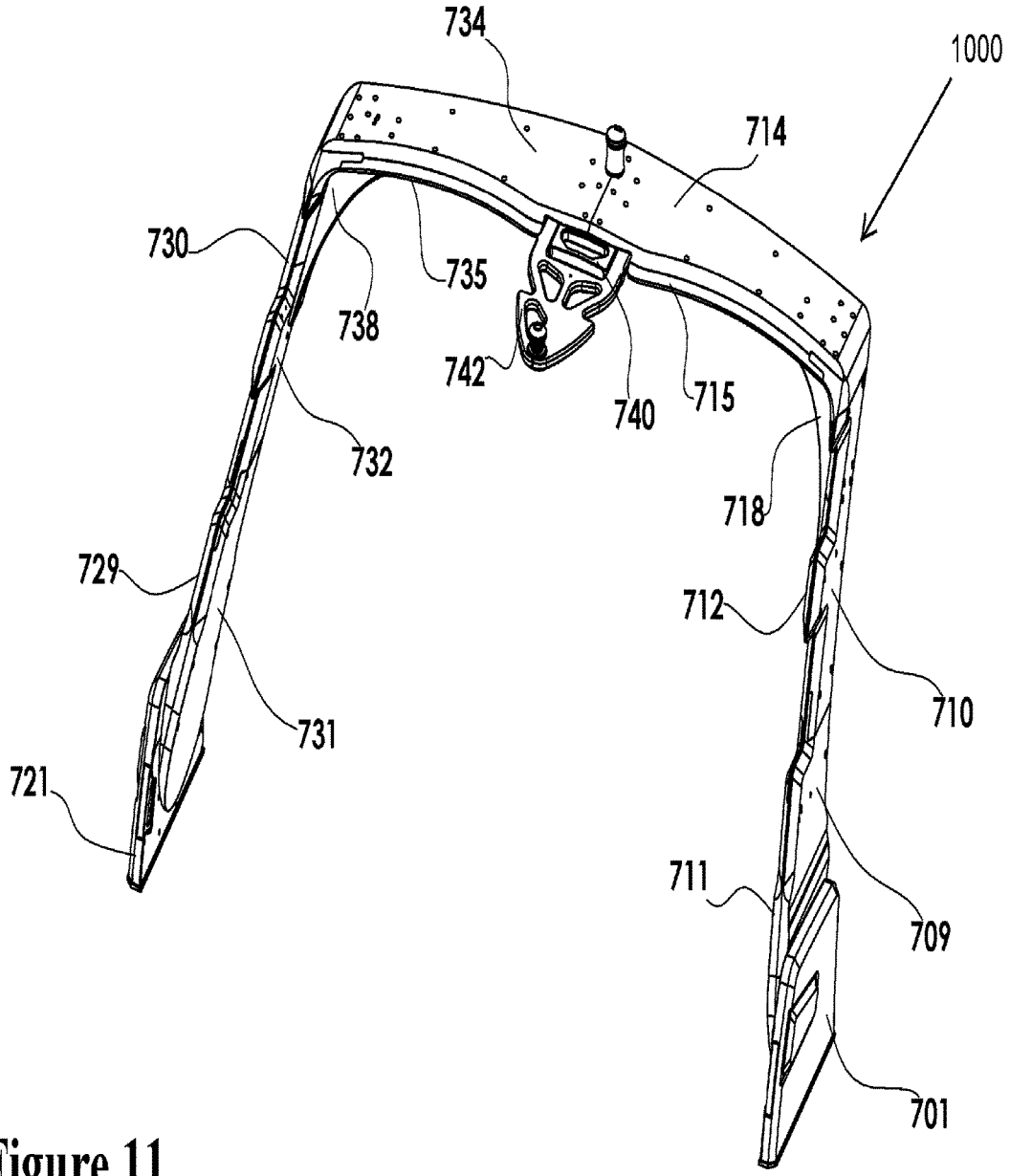
FIG. 11 illustrates a perspective view of the ski/wake tower assembly of FIG. 10 without the attached accessories.
Figure 12:
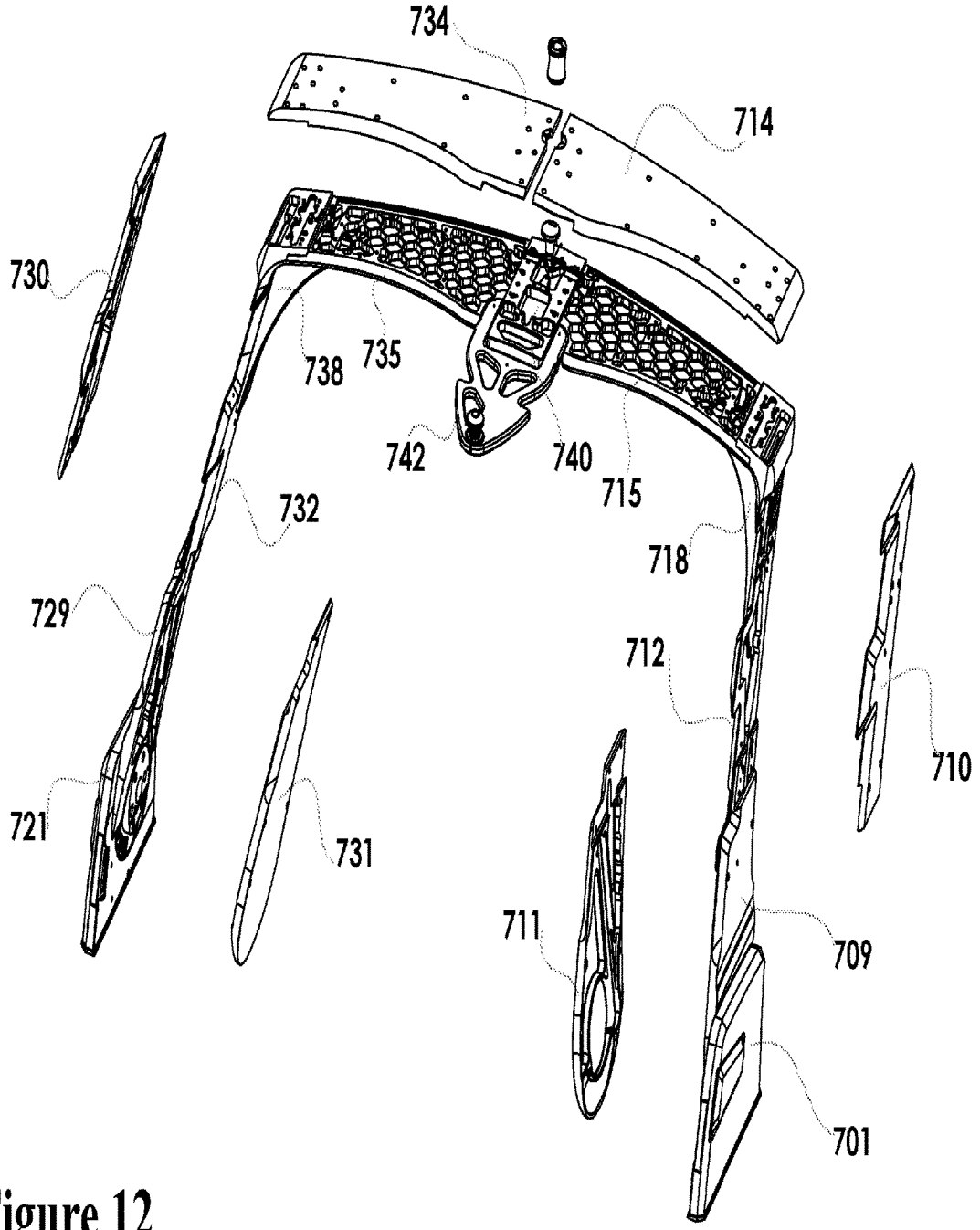
FIG. 12 illustrates an exploded view of the ski/wake tower assembly of FIG. 11.

FIG. 11 illustrates a perspective view of the wake tower assembly of FIG. 10 without the attached accessories, and FIG. 12 illustrates an exploded view of the wake tower assembly of FIG. 11. In various example embodiments of the present general inventive concept, the structural elements of the wake tower are created from 100% billet machined components. Assembly may be accomplished with a combination of locating dowel pins and screws for securing the assembly together. This provides a mechanism for constructing and assembly of a ski/wake tower with no welds. Various example embodiments may include tower components with an internal or external honeycomb structure for optimized strength to weight ratio. By forming the wake tower with these precision formed billet machined components, the previously discussed problems with welding are avoided, and the resulting wake tower will have a much better fit and function due to the precisely made parts. As seen in FIGS. 11-12, in example embodiments employing the honeycomb inner structure, various kinds of panels or other outer components may be added for cosmetic and/or utility purposes. In FIGS. 11-12, a port upper 734 and starboard upper 714 are provided to the top of the arch portion of the wake tower, and a port lower 735 and starboard lower 715 are provided to the bottom of the arch portion. These uppers and lowers are provided with various attachment portions to add attachments such as those illustrated in FIG. 10. Other outer components may be added as illustrated in FIGS. 11-12, and as shown in the parts list table included herein.

Figure 13:
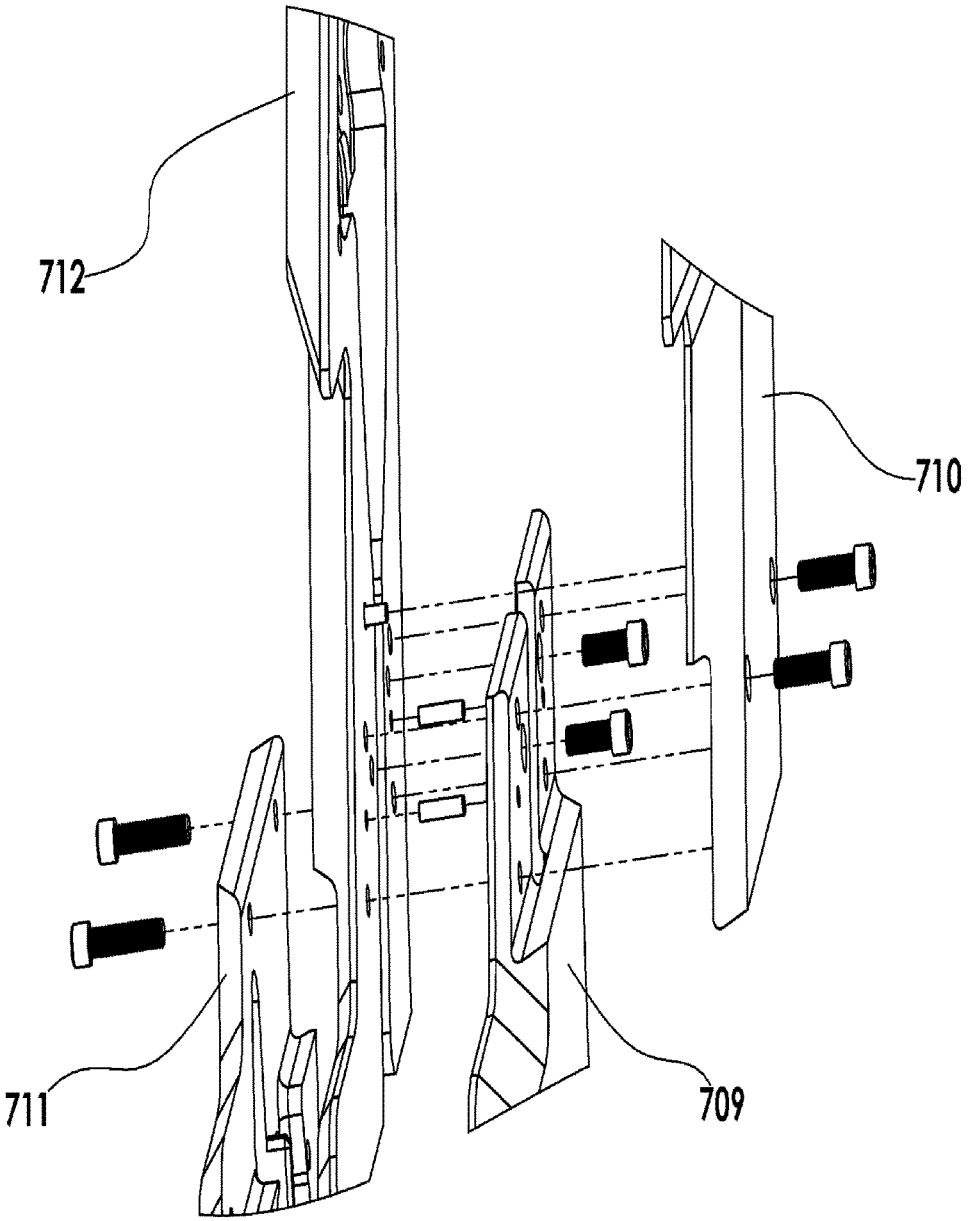
FIG. 13 illustrates an exploded view of a leg assembly of the ski/wake tower assembly of FIG. 11.

FIG. 13 illustrates an exploded view of a leg assembly of the wake tower assembly of FIG. 11. In the example embodiment of FIG. 13, the leg portions of the wake tower are formed of a plurality of precision components secured together by dowel pins and screws. As seen in FIG. 13, top portions of the starboard leg cover 711 and starboard leg base 709 are overlapped with bottom portions of the starboard inner leg 712 and starboard outer leg 710. The overlapping portions are precision made, and the overlapping configuration secured with an attachment means such as the dowel pins and screws allows a more precisely made wake tower without the inaccuracies and weaknesses that result from welding pieces together. The lap joints also allow an ease of assembly, and an ease of disassembly for maintenance purposes. Such disassembly is not possible with welded components.

Figure 14:
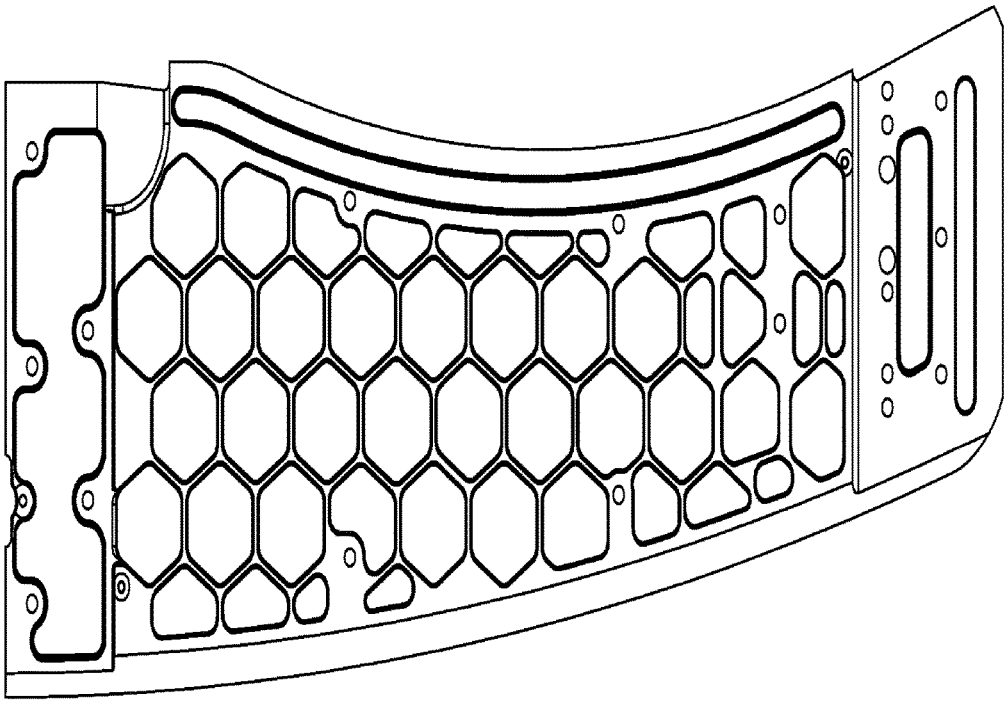
FIG. 14 illustrates a honeycomb CNC (Computer Numerical Control) machining pattern used in internal portions of the wake tower assembly according to an example embodiment of the present general inventive concept.

FIG. 14 illustrates a honeycomb CNC machining pattern used in internal portions of the wake tower assembly according to an example embodiment of the present general inventive concept. Such a configuration allows an optimal strength to weight ratio of the wake tower components.

Example embodiments of the present general inventive concept can be achieved by providing a method of manufacturing a wake tower for use with a watercraft, including machining a plurality of components, each component being machined from a single billet of raw material, fastening each component to one or more of the other components in an overlapping manner to form the arch portion, without welding any of the components, and assembling first and second ends of the arch portion to first and second pivoting structures, respectively, to facilitate rotational movement of the arch portion relative to the pivoting structures. One or more of the components can include a honeycomb machining pattern therein, as illustrated in FIG. 14.

Figure 15:
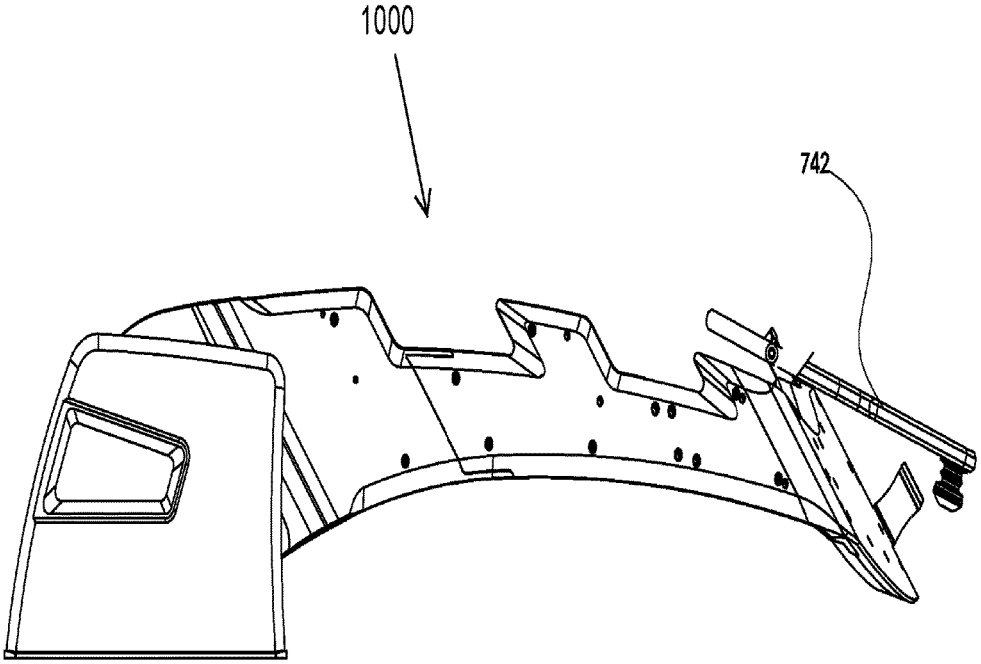
FIG. 15 illustrates the example ski/wake tower of FIG. 1 with a pivotable tow platform folded to reduce the effective height of the wake tower in the lowered position.

FIG. 15 illustrates the wake tower 1000 of FIG. 1 with the tow platform 742 folded to reduce the effective height of the wake tower in the lowered position.

Figure 16:
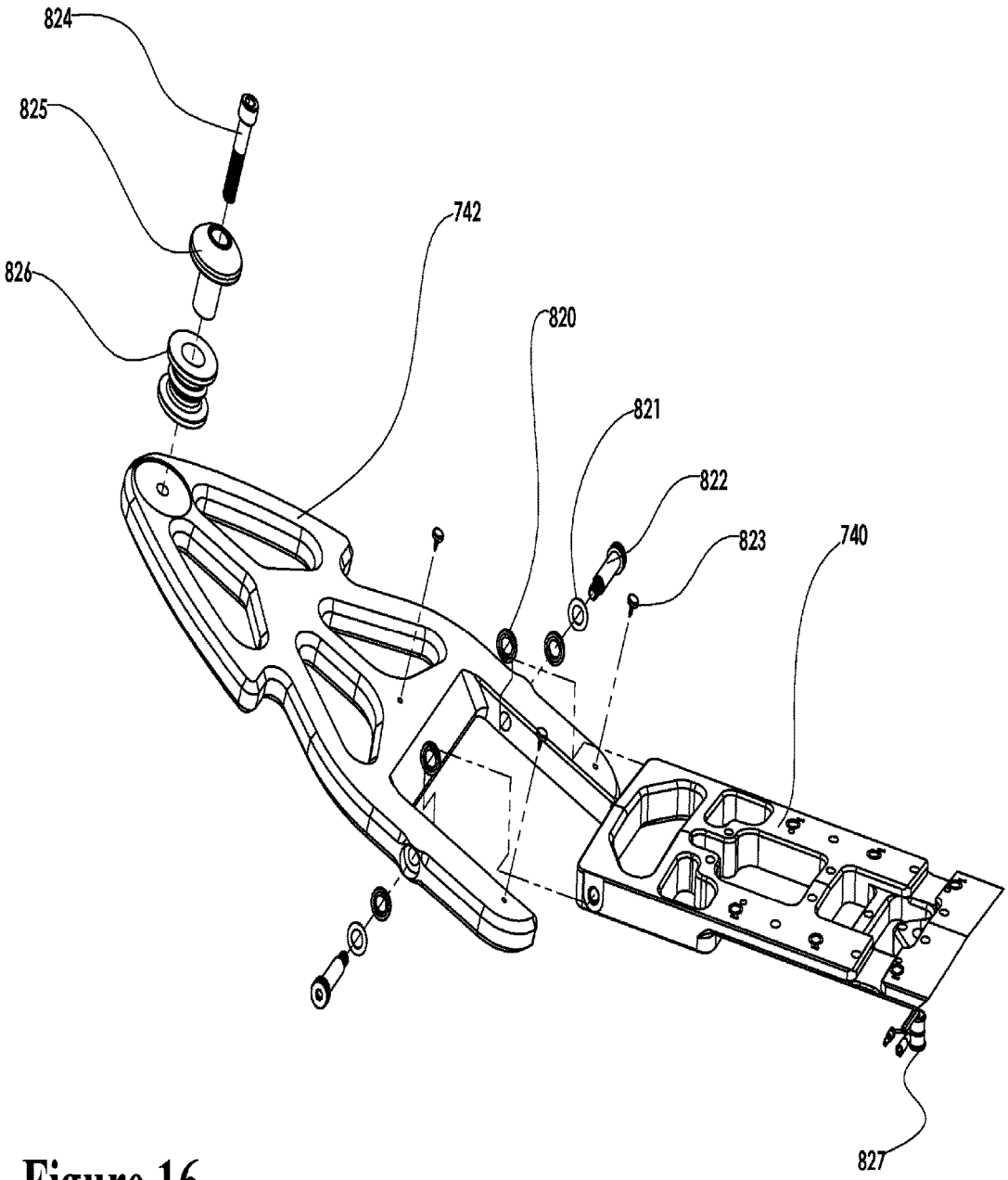
FIG. 16 illustrates an exploded view of the example tow plate assembly of FIGS. 1, 2, and 15.

FIG. 16 illustrates an exploded view of the tow plate assembly of FIGS. 1, 2, and 15 according to an example embodiment of the present general inventive concept. As illustrated in FIG. 16, the tow platform 742 can be rotatably coupled to the tow center base 740 such that the tow platform is rotatably coupled to the arch portion. In the illustrated embodiment, when assembled to the wake tower, as illustrated in FIGS. 11 and 12, the tow platform 742 can be configured to heel out against the starboard upper 714 and the port upper 734 to limit the rotation of the tow platform 742 in one direction (e.g. the lower direction). In FIGS. 11-12, a port upper 734 and starboard upper 714 are provided to the top of the arch portion of the wake tower, and a port lower 735 and starboard lower 715 are provided to the bottom of the arch portion. These uppers and lowers are provided with various attachment portions such as those illustrated in FIG. 10. That is, referring to FIGS. 11, 12 and 16, the tow platform 742 can be configured to be rotatably coupled to the top of the arch portion such that an end of the tow platform (such as a pair of tined ends as illustrated in FIG. 16), are heeled against a top surface 734, 714 of the arch portion to form a positive stop inhibiting rotation of the tow platform in a first, or downward, direction, yet there is clearance provided in a lower surface 715, 735 of the arch portion to allow rotation of the tow platform in a second, or upward, direction. The attachment portions can include frictional washers or various other known or later developed components to fasten the tow platform to the arch portion in order to provide a yieldable resisting force against tow platform rotation. The yieldable resisting force enables a user to rotate the tow platform relative to the arch portion to reduce the effective height of the wake tower in the lowered position, yet inhibiting the tow platform from flapping relative to the wake tower during operation or transport of the watercraft.

FIGS. 17A to 20B illustrate relative positions of the port and starboard locking mechanisms during various stages of the process of pivoting the wake tower between a lowered and raised position. For convenience of description, the respective locking mechanisms are referred to as being on the 'port' or 'starboard' sides, but it is understood the mechanisms could be switched or interchanged from one side to the other without departing from the scope of the present general inventive concept.

Figure 17B:
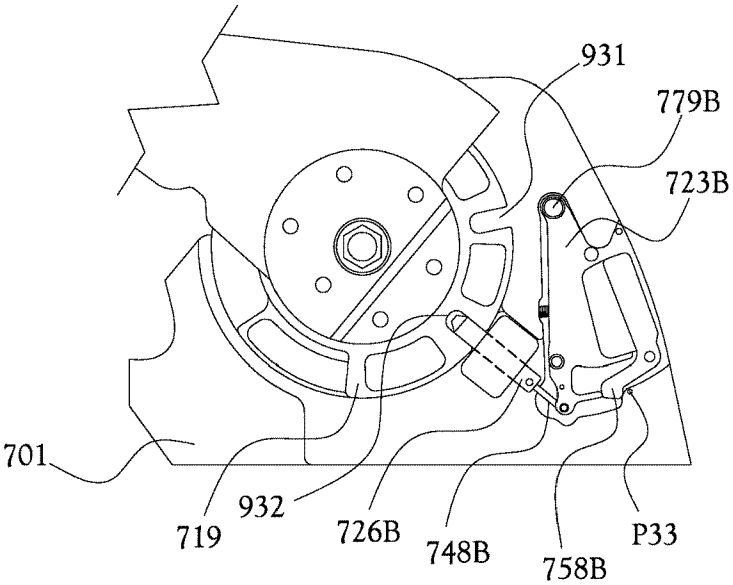
FIGS. 17A to 20B illustrate relative positions of the port and starboard locking mechanisms during various stages of the process of pivoting the wake tower between a lowered and raised position, according to example embodiments of the present general inventive concept.
Figure 17A:
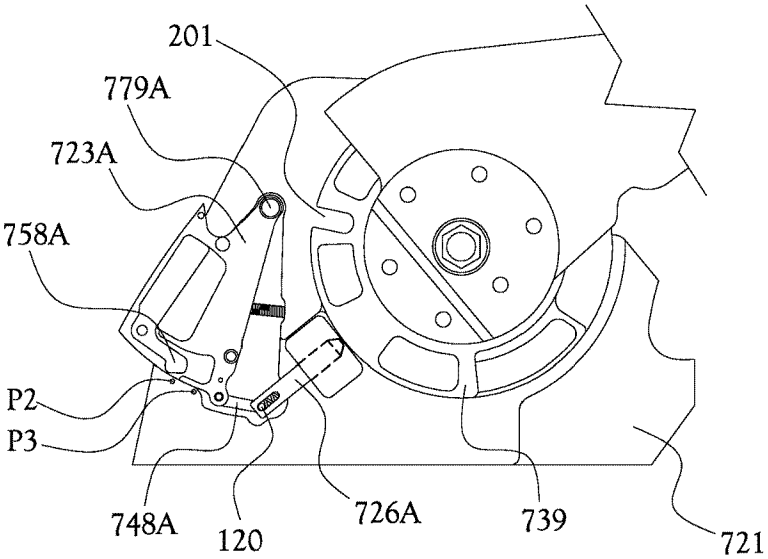

FIGS. 17A and 17B illustrate the port and starboard sides of the respective locking systems when the wake tower is locked in the lowered or transport position. Here, the locking pin 726A on the port side (FIG. 17A) is fully disengaged from the ring 739 because the handle 723A has been rotated about axis 779A such that the lever 758A is positioned in the disengaged position behind stop pin P2, thus pulling pin 726A away from ring 739 via link 748A. By comparison, the locking pin 726B on the starboard side (FIG. 17B) is fully engaged with slot 932 because the handle 723B has been rotated about axis 779B such that lever 758B is secured in the locked position by stop pin P33, driving pin 726B into slot 932 via link 748B.

Figure 18B:
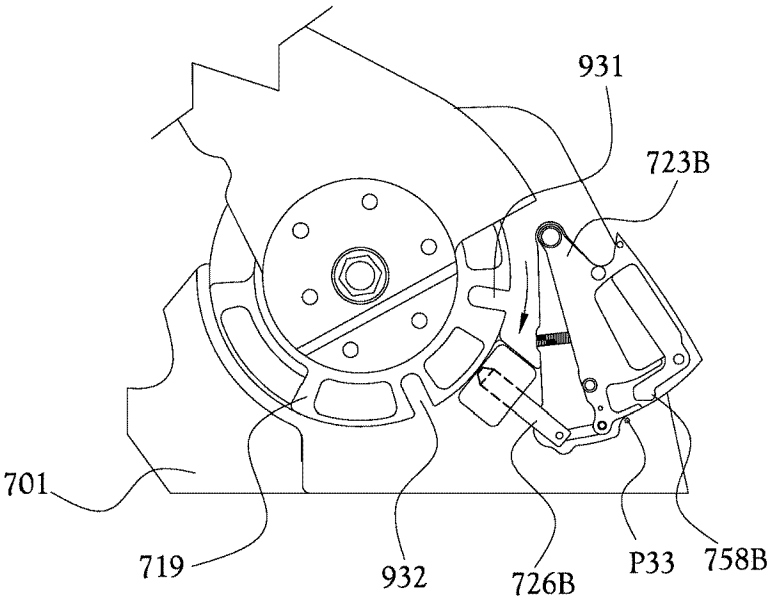
Figure 18A:
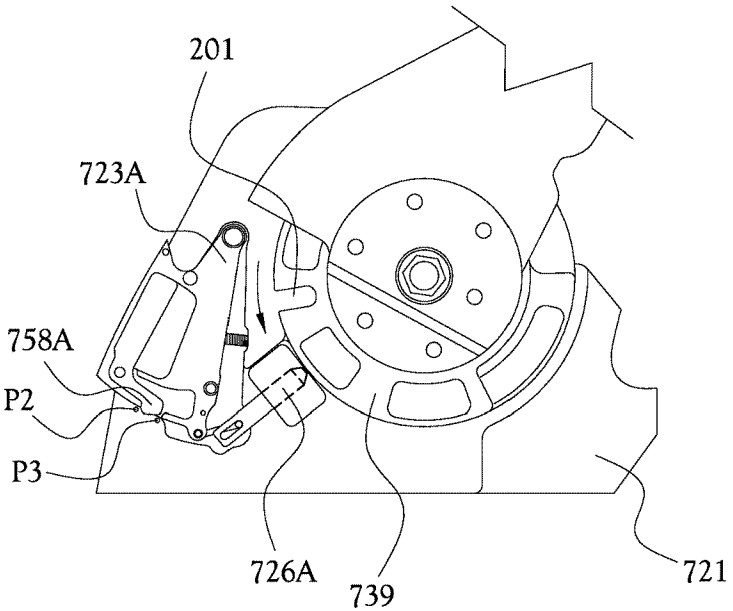
Figure 19B:
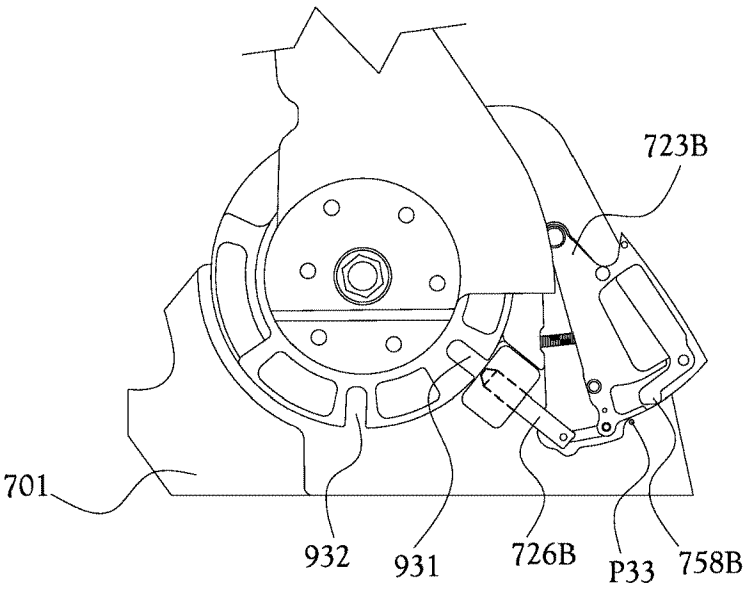
Figure 19A:
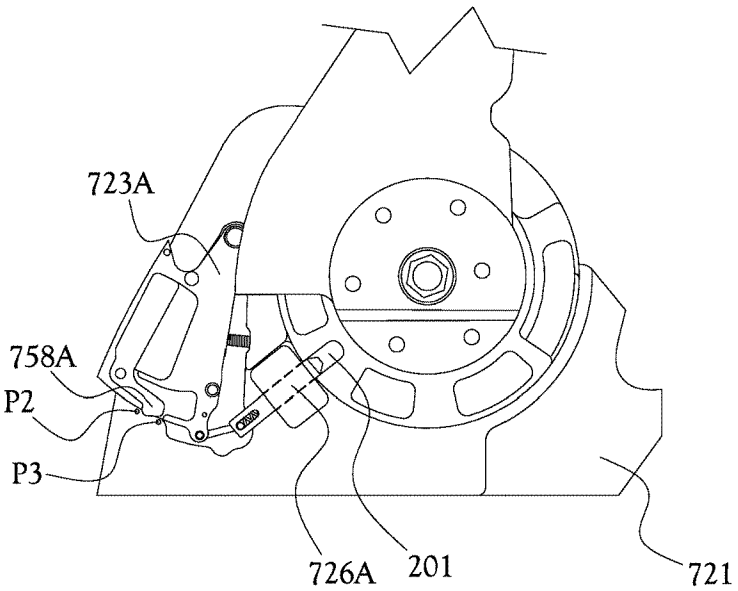
Figure 20B:
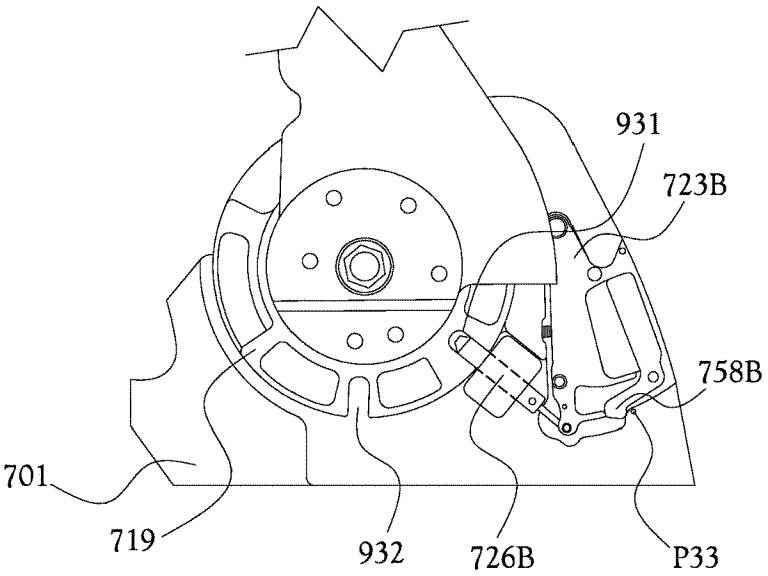
Figure 20A:
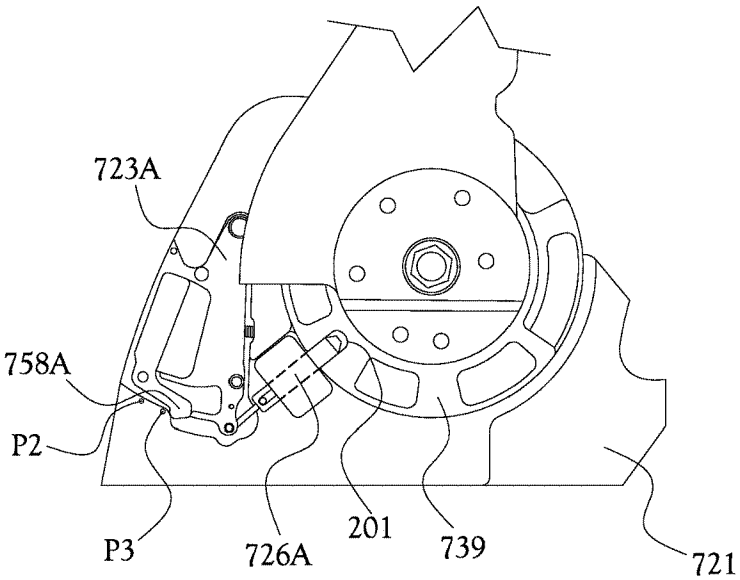

FIGS. 18A and 18B illustrate the port and starboard sides of the respective locking systems when the wake tower is in the process of being raised to the raised position. In FIG. 18B, the locking pin 726B has been withdrawn from slot 932 because the handle 723B has been rotated by the operator such that the locking pin 726B has been pulled away from slot 932, enabling lever 758B to be positioned behind stop pin P33, thus placing the handle in the fully disengaged position. The fully disengaged position allows ring 719 to rotate clockwise as indicated by the direction arrow as the wake tower is lifted by the operator. However, before lifting the wake tower, the operator can rotate handle 723A (FIG. 18A) such that lever 758A is placed in the pre-loaded position against stop pin P2. This pre-loaded position serves to bias the locking pin 726A against the outer diameter of ring 739 due to the movement of the lever 758A driving pin 726A against the ring 739. In this position, as the tower is lifted, the locking pin 726A rides along the outer diameter of ring 739 until slot 201 becomes aligned, at which time locking pin 726A fires into slot 201, as illustrated in FIG. 19A. This serves to initially lock the tower in the upright position, allowing the operator to safely release the tower without it falling down.

With the tower partially locked by pin 726A as shown in FIG. 19A, the slot 931 is aligned with locking pin 726B. Thus, the operator can rotate handle 723B to secure lever 758B against stop pin P33 in a fully engaged position (FIG. 20B) to lock the starboard side. Once this is accomplished, the operator can then fully rotate handle 723A to secure lever 758A against stop pin P3 in a fully engaged position to fully drive locking pin 726A into slot 201, thus completely locking both port and starboard sides of the tower in the upright position, in a one person operation.

Various example embodiments of the present general inventive concept can be achieved by providing a wake tower assembly including a top portion and first and second leg portions to form a wake tower, the top and leg portions formed of a plurality of components secured together with readily removable securing members, first and second pivoting structures respectively coupled to bases of the respective leg portions such that the wake tower rotates between lowered and upright positions about the pivoting structures, and a locking mechanism provided to the first pivoting structure to mechanically lock the wake tower in an upright position.

The locking mechanism may include a ring coupled to the base of the first leg portion and configured to rotate about an axis, a lock pin configured to be selectively biased toward the ring, a receiving portion formed in the ring to receive the lock pin to lock the wake tower in the upright position. The locking mechanism may further include a handle locking assembly including a handle portion configured to rotate around a fixed point, a lever portion to selectively hold the handle locking assembly in one or more positions, a link rotatably coupled at a first end to the handle portion, the lock pin coupled to a second end of the link such that the lock pin is rotatable and reciprocally slidable about the second end of the link, and a biasing member provided to the lock pin to bias the lock pin toward the ring, wherein the handle locking assembly is configured to be selectively moved to an unlocked position and a pre-loaded locking position.

The lock pin may not interact with the ring when the handle locking assembly is in the unlocked position. The lock pin may contact the ring without preventing movement of the ring, and the biasing member may be compressed to force the lock pin in the direction of the ring, when the handle locking assembly is in the pre-loaded locking position. The lock pin may be at least partially received by the receiving portion of the ring when the wake tower is moved to the upright position, whereby further rotation by the ring is restricted. The handle locking assembly may be configured to be moved to a secured lock position in which a larger portion of the lock pin is received by the receiving portion of the ring than in the pre-loaded locking position. The lever may include a lever plate that engages with a base of the locking mechanism at different locations to hold the handle locking assembly in position. The lever plate may be biased to engage with the base of the locking mechanism. The lever may include a release portion configured to be pressed by a user to disengage the lever plate from the base of the locking mechanism. The components forming the top and leg portions may be machined from billet aluminum. The components forming the top and leg portions may be joined by overlapping ends of two or more components and coupling the ends together with mechanical securing members. The mechanical securing members may be dowel pins and screws.

Example embodiments of the present general inventive concept may be achieved by providing a locking mechanism to facilitate locking of a reciprocal device between first and second positions, including a first handle portion configured to drive a first locking member between a disengaged, pre-loaded, and fully engaged position relative to a first end of a reciprocal device, a second handle portion configured to drive a second locking member between a disengaged and fully engaged position relative to a second end of a reciprocal device, wherein when the first locking member is in the preloaded position and the second locking member is in the disengaged position as the reciprocating device is transitioning between first and second positions, the first locking member is biased against an arcuate surface of the first end of the reciprocal device such that the first locking member rides along the arcuate surface as the reciprocating device is transitioning from the first position to the second position, and when the reciprocating device reaches the second position, a biasing force of the first locking member drives the first locking member into a first receptacle of the arcuate surface to lock the reciprocal device in the second position, and wherein when the reciprocal device is locked in the second position, the second locking member is configured to be aligned with a second receptacle of the second end such the second handle drives the second locking member into the second receptacle.

When the reciprocating device is in the second position, the biasing force can drive the first locking member to a first depth within the first receptacle and the first handle portion can be configured to pivot to drive the first locking member to a second depth within the first receptacle, the second depth being greater than the first depth.

The reciprocating device can be a wake tower for a boat, and the first and second ends can correspond to port and starboard sides of the boat.

Example embodiments of the present general inventive concept provide a wake tower assembly having an arch portion configured to extend across a width of the watercraft, first and second pivoting structures respectively coupled to first and second ends of the arch portion, the first and second pivoting structures being configured to attach to port and starboard portions of the watercraft to facilitate rotational movement of the arch portion between a lowered position and an upright position relative to the watercraft, and a first locking mechanism provided to the first pivoting structure, the first locking mechanism including a biased pin member configured to engage, for example penetrate, an opening of the first end such that when the arch portion is rotated from the lowered position to the upright position, a biasing force of the biased pin member causes, for example drives, the biased pin member to engage, enter, or penetrate the opening such that the biased pin member is captured within the opening, such that the biased pin member and the opening cooperate to mechanically lock the arch portion in the upright position.

A second locking mechanism can be provided to the second pivoting structure, where the second locking mechanism includes a second pin member configured to engage, for example penetrate, an opening of the second end when the arch portion is in the lowered position such that the second pin member cooperates with the opening of the second end to mechanically lock the arch portion in the lowered position, the second pin member being configured to engage or penetrate another opening of the second end when the arch portion is in the upright position to mechanically lock the arch portion in the upright position.

Various example embodiments of the present general inventive concept may also provide a method of manufacturing a locking mechanism and/or a wake tower as described above, including machining a plurality of components, each from a single billet of material, fastening each of the components to one or more others of the components without welding to form a wake tower structure, and assembling the wake tower structure to a pivoting structure having an automatic locking mechanism to lock the wake tower structure in an upright position, the wake tower structure being configured to rotate about the pivoting structure between the upright position and a lowered position. The fastening may include forming lap joints by overlapping two or more end portions of the components together. The lap joints may be formed by securing the overlapped end portions together with dowel pins and screws. The single billet of material may include aluminum.

Example embodiments of the present general inventive concept can be achieved by proving a method of manufacturing a wake tower, including machining a plurality of components, each component being machined from a single billet of raw material, fastening each component to one or more of the other components in an overlapping manner to form an arch portion, without welding any of the components, and assembling first and second ends of the arch portion to first and second pivoting structures, respectively, such that the arch portion rotates relative to the pivoting structures.

One or more of the components can include a honeycomb machining pattern therein.

The tow platform component can be rotatably coupled to the assembly, to facilitate reducing the effective height of the wake tower in the lowered position.

Various example embodiments of the present general inventive concept may provide a boat equipped with the wake tower assembly including a top portion and first and second leg portions to form a wake tower, the top and leg portions formed of a plurality of components secured together with readily removable securing members, first and second pivoting structures respectively coupled to bases of the respective leg portions such that the wake tower rotates between lowered and upright positions about the pivoting structures, and a locking mechanism provided to the first pivoting structure to mechanically lock the wake tower in an upright position. The first and second pivoting structures may be respectively secured proximate the gunwale on both sides of the boat.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A wake tower assembly for use with a watercraft, the wake tower assembly comprising:

an arch comprising a first leg, a second leg, and a tow platform located between upper ends of the first leg and the second leg;

a first leg base and a second leg base, the first leg base attached to one of a port and starboard gunwale of the watercraft and the second leg base attached another of the one of the port and starboard gunwale of the watercraft, wherein the first leg and the second leg are rotatably coupled with the first leg base and the second leg base at lower ends of the first leg and the second leg;

a first slot formed on the lower end of the first leg, the first slot corresponding to an upright position of the arch; and a first locking mechanism positioned adjacent the lower end of the first leg, the first locking mechanism including a movable pin for engaging the first slot of the first leg to secure the arch in the upright position.

2. The wake tower assembly of claim 1, further comprising a second slot formed on the lower end of the first leg, the second slot corresponding to a lowered position of the arch, wherein the movable pin of the first locking mechanism engages the second slot to secure the arch in the lowered position.

3. The wake tower assembly of claim 1, further comprising:

a first slot formed on the lower end of the second leg, the first slot of the second leg corresponding to an upright position of the arch;

a second locking mechanism positioned adjacent the lower end of the second leg, the second locking mechanism including a movable pin for engaging the first slot formed on the lower end of the second leg to further secure the arch in the upright position.

4. The wake tower assembly of claim 1, wherein the movable pin of the first locking mechanism is biased towards the lower end of the first leg to engage the first slot of the first leg when the movable pin is aligned with the first slot of the first leg.

5. The wake tower assembly of claim 1, further comprising a first handle associated with the first leg base, the first handle connected to the movable pin to adjust a position of the movable pin relative to the first slot of the first leg.

6. The wake tower assembly of claim 1, wherein the first slot is formed into a ring located at the lower end of the first leg.

7. The wake tower assembly of claim 6, further comprising a second slot formed into the ring located at the lower end of the first leg, the second slot corresponding to a lowered position of the arch, wherein the movable pin of the first locking mechanism engages the second slot to secure the arch in the lowered position.

8. The wake tower assembly of claim 3, further comprising a second slot formed on the lower end of the first leg, the second slot of the lower leg corresponding to a lowered position of the arch, wherein the second slot engages the movable pin of the first locking mechanism such that only the first locking mechanism secures the arch in a lowered position.

9. The wake tower assembly of claim 5, further comprising a first stop pin located adjacent to the first handle associated with the first leg base, wherein the first handle releasably contacts the stop pin to maintain the attached movable pin in a preloaded position that is not fully engaged with the first slot of the first leg.

10. A wake tower assembly for use with a watercraft, the wake tower assembly comprising:

an arch comprising a first leg, a second leg, and a tow platform located between upper ends of the first leg and the second leg;

a first leg base and a second leg base, the first leg base attached to one of a port and starboard gunwale of the watercraft and the second leg base attached another of the one of the port and starboard gunwale of the watercraft, wherein the first leg and the second leg are rotatably coupled with the first leg base and the second leg base at lower ends of the first leg and the second leg;

a first slot formed on the lower end of the first leg, the first slot corresponding to an upright position of the arch;

a first slot formed on the lower end of the second leg, the first slot of the second leg corresponding to an upright position of the arch;

a first locking mechanism positioned adjacent the lower end of the first leg, the first locking mechanism including a movable pin for engaging the first slot of the first leg to secure the arch in the upright position;

a second locking mechanism positioned adjacent the lower end of the second leg, the second locking mechanism including a movable pin for engaging the first slot formed on the lower end of the second leg to further secure the arch in the upright position.

11. A wake tower assembly for use with a watercraft, the wake tower assembly comprising:

an arch comprising a first leg, a second leg, and a tow platform located between upper ends of the first leg and the second leg;

a first leg base and a second leg base, the first leg base attached to one of a port and starboard gunwale of the watercraft and the second leg base attached another of the one of the port and starboard gunwale of the watercraft, wherein the first leg and the second leg are rotatably coupled with the first leg base and the second leg base at lower ends of the first leg and the second leg;

a first slot formed on the lower end of the first leg, the first slot corresponding to an upright position of the arch;

a first slot formed on the lower end of the second leg, the first slot of the second leg corresponding to an upright position of the arch;

a first locking mechanism positioned adjacent the lower end of the first leg, the first locking mechanism including a movable pin for engaging the first slot of the first leg to secure the arch in the upright position;

a second locking mechanism positioned adjacent the lower end of the second leg, the second locking mechanism including a movable pin for engaging the first slot formed on the lower end of the second leg to further secure the arch in the upright position;

a second slot formed on the lower end of the first leg, the second slot of the lower leg corresponding to a lowered position of the arch;

wherein the second slot engages the movable pin of the first locking mechanism such that only the first locking mechanism secures the arch in a lowered position.

* * * * *